US007581475B2

(12) United States Patent
Moellering

(10) Patent No.: US 7,581,475 B2
(45) Date of Patent: Sep. 1, 2009

(54) STRIPPER UNIT FOR A PUNCH RETAINER

(76) Inventor: David J. Moellering, 3281 W. Shore Dr., Orchard Lake, MI (US) 48324

( * ) Notice: Subject to any disclaimer, the term of this patent is extended or adjusted under 35 U.S.C. 154(b) by 342 days.

(21) Appl. No.: 11/485,863

(22) Filed: Jul. 13, 2006

(65) Prior Publication Data

US 2007/0028737 A1 Feb. 8, 2007

Related U.S. Application Data

(60) Provisional application No. 60/706,310, filed on Aug. 8, 2005.

(51) Int. Cl.
*B26F 1/14* (2006.01)

(52) U.S. Cl. ..... 83/143; 83/686; 83/698.91

(58) Field of Classification Search ..... 83/111, 83/146, 684, 698.91, 698.31, 123, 128, 142, 83/143, 690, 686
See application file for complete search history.

(56) References Cited

U.S. PATENT DOCUMENTS 1,723,935 A * 8/1929 Henricson ..... 83/140
2,168,377 A * 8/1939 Wales ..... 83/140
4,862,782 A * 9/1989 Ernst ..... 83/552
4,993,295 A * 2/1991 Dacey, Jr. ..... 83/140
5,709,019 A * 1/1998 Sawdon ..... 29/243.5
5,992,285 A * 11/1999 Talarico ..... 83/684
6,182,545 B1 * 2/2001 Janek, Jr. ..... 83/13
2006/0071062 A1 4/2006 Weigelt

FOREIGN PATENT DOCUMENTS

DE 2345513 10/1974
DE 29804632.6 5/1998
NL 789408 1/1958

* cited by examiner

*Primary Examiner*—Kenneth E. Peterson
*Assistant Examiner*—Phong Nguyen
(74) *Attorney, Agent, or Firm*—Gifford, Krass, Sprinkle, Anderson & Citkowski, P.C.

(57) ABSTRACT

A stripper unit incorporates a precision threaded plug that preloads a mechanical die spring that, in turn, preloads the movable or traveling stripper adjacent the punch tip. The precision threaded plug simultaneously accurately locates the stripper unit on a commercially available ball-lock punch retainer. The stripper unit is entirely self-contained on the face of the ball-lock punch retainer, thus minimizing the space required on the press platen.

6 Claims, 2 Drawing Sheets

FIG 1
Prior Art
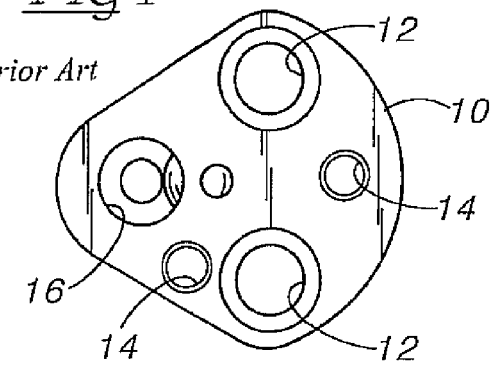
FIG 3
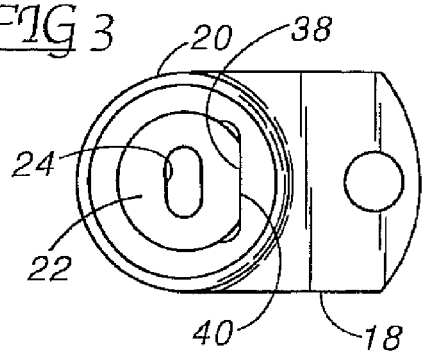
FIG 2
Prior Art
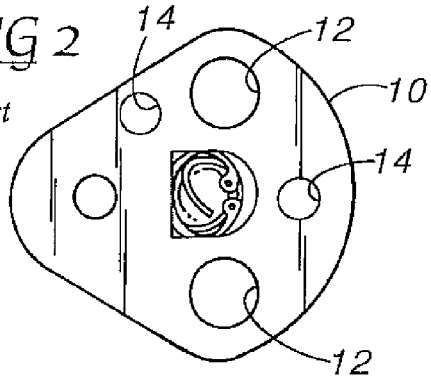
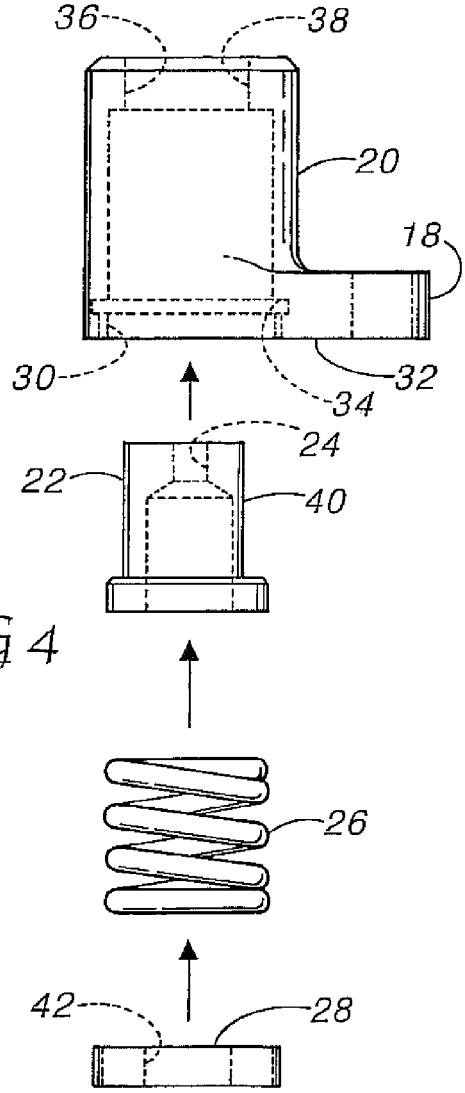
FIG 4

STRIPPER UNIT FOR A PUNCH RETAINER

This application claims the benefit of provisional patent application No. 60/706,310, filed Aug. 8, 2005.

BACKGROUND OF THE INVENTION

The field of the invention pertains to punches and dies for forming holes and depressions in metals. In particular, the invention pertains to devices and accessories for preventing work pieces from adhering to punches during high-speed, high production manufacturing.

Examples of modern punch retainers are shown in applicant's previous U.S. Pat. Nos. 5,337,835, 5,410,932 and Des. 351,395. Views of these punch retainers are also shown in FIGS. 1 and 2. Modern punches for certain applications utilize either metal or polyurethane strippers to prevent work piece drag on the punch. The metal stripper units typically extend over the sides of the punch retainers or otherwise interfere with the close placement of punch retainers. Polyurethane strippers require separate metal retainers to accurately position the strippers on the punch retainers. With a view to eliminating some of the disadvantages attendant to previous stripper units, the following more compact stripper unit has been developed.

SUMMARY OF THE INVENTION

The new stripper unit incorporates a precision threaded plug that preloads a mechanical die spring and simultaneously locates the stripper unit on a commercially available ball-lock punch retainer. The ball-lock punch retainers are commonly used in the tool, die and metal stamping industry, and the new stripper unit is an improvement on various punch stripping units commercially available today. Use of the preloaded mechanical die spring provides for time-tested long life.

BRIEF DESCRIPTION OF THE DRAWINGS

FIG. 1 is a top plan view of a punch retainer;

FIG. 2 is a bottom plan view of a punch retainer;

FIG. 3 is a top plan view of the new stripper unit;

FIG. 4 is a side exploded view of the new stripper unit;

DESCRIPTION OF THE PREFERRED EMBODIMENT

Figure 5:
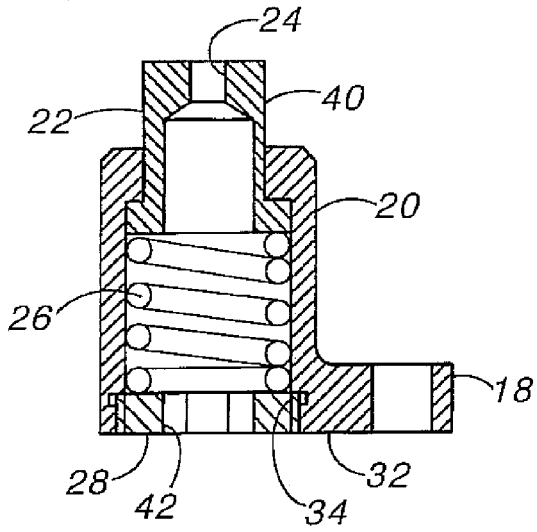
FIG. 5 is a side cross-section of the new stripper unit.

Illustrated in FIGS. 1 and 2 are the top and bottom views of a typical commercially available ball-lock punch retainer 10. The punch retainer 10 includes bolt holes 12 for attaching the punch retainer to a press platen (not shown), threaded holes 14 with dowel locating holes at bottom, and punch retention hole 16.

In FIG. 3, the top plan view of the new stripper unit 18 illustrates the very robust stripper body 20 and the movable stripper 22. The movable stripper 22 is formed with a hole 24 shaped to match the shape of the punch (not shown).

In FIG. 4, the components of the stripper unit 18 are shown in order of assembly. The stripper 22 is first inserted into the stripper body 20 followed by the mechanical die spring 26 and the precision threaded plug 28. The precision threaded plug 28 screws into a precision threaded hole 30 in the bottom 32 of the stripper body 20 and seats on an accurately machined counterbore ledge 34.

The upper bore 36 in the stripper body 20 includes a flat 38, such that the upper bore 36 has a "D" shape. The stripper 22 is also "D" shaped to match the D-shape of the upper bore 36 and thereby provide assembly only in its correct position. FIG. 5 illustrates in cross-section the completely assembled stripper unit 18. As shown, the precision threaded plug 28 is tightly seated on the counterbored ledge 34. It is appreciated that FIGS. 4 and 5 teach bottom 32 is generally flat and that threaded plug 28 screws into the precision threaded hole 30 leaving a flush surface across the bottom 32.

Figure 6:
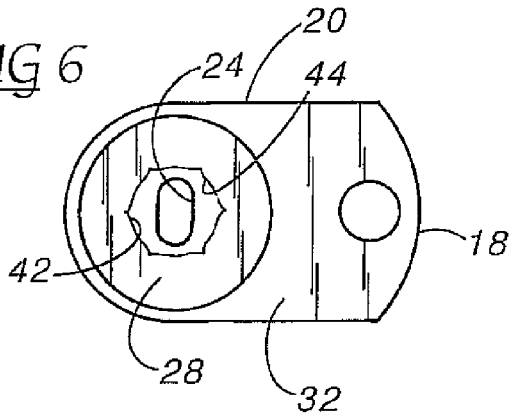
FIG. 6 is a bottom plan view of the new stripper unit.

In FIG. 6, the bottom view of the stripper unit 18 shows the precision threaded plug 28 formed with a hexagonal hole 42 therethrough. The flats 44 of the hexagonal hole 42 are sized to accurately contact the punch (not shown) and thereby accurately align the stripper unit 18 over the punch retention hole 16. Optionally, the hexagonal hole 42 may be made slightly smaller, whereby each flat 44 is formed with a slight concavity matching the curvature of the punch retention hole 16. A hex wrench can be used to tighten the precision threaded plug 28 in place.

Figure 7:
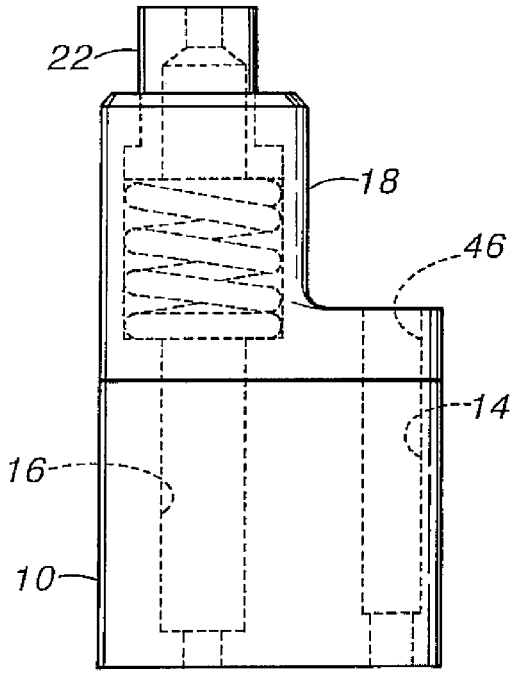
FIG. 7 is a side view of the new stripper unit on a punch retainer.

Thus, the stripper unit 18 can be perfectly aligned on the punch retainer 10, as shown in FIG. 7 with a punch (not shown) through the hexagonal hole 42, before a machine screw (not shown) is inserted through hole 46 in the stripper unit 18 and threaded into hole 14 of the punch retainer 10 to fasten the stripper unit to the retainer.

The construction above provides a number of improved features. The precision threaded plug 28 locates the stripper unit 18 while simultaneously pre-loading the die spring 26 for improved die spring life. Because the plug 28 has a precision machined hexagonal hole 42, the stripper unit 18 is accurately positioned and retained on its mating retainer 10. The hexagonal hole 42 provides an alien wrench hex over the precision hole to provide for easy assembly and disassembly. The new design provides that all die spring 26 and stripping forces are completely isolated in the very robust stripper body 20 with no force being transferred to any outside component. Fully assembled, the stripper unit 18 is completely "self-contained," eliminating the risk of components being lost, or, even upon catastrophic failure, any of the units' components being jettisoned into the stamping die. In addition, it is appreciated that FIGS. 5 and 7 teach the stripper unit 18 can be attached to the punch retainer 10 as a single unit and the bottom 32 can fit flush against the punch retainer 10.

The precision threaded plug 28 is designed to bottom out in its mating pocket in the stripper body 20, which automatically sets the die spring 26 pre-load and is fail safe, so the spring cannot be overloaded.

Unlike some stripper units currently available, the new stripper unit 18 universally fits all standard ball-lock punch retainers, and most importantly requires no retainer alterations.

The movable or traveling stripper 22 is preferably of a hardened tool steel construction with a lubricating coating to promote smooth stripping movement. The stripper 22 is guided not only by the "D" body shape, but also by the stripper's head diameter or hole size and shape 24. This provides a much improved condition that will ensure the stripper 22 cannot twist or cock and jam during production and will better facilitate side load to the stripper when stripping non-flat surfaces.

The round portion of the stripper 22 and all the round features of the stripper unit 18 are co-located along the centerline of the punch and pierced hole, which simplifies design and manufacture of the stripper unit. The unique "D" shape 40 of the stripper 22 provides a failsafe assembly, allowing the stripper 22 to be assembled in the stripper body 20 only in the correct position.

The pre-loading of the die spring 26 and stripper 22 provides instant stripping force upon contact with the work piece. The instant stripping force on contact facilitates simplification of the calculations and timing questions, which are issues, especially with respect to cam activated die applications. The pre-loading also makes the overall stripper unit 18 more compact. The stripper body 20 is a one-piece construction designed with a robust heel for the attachment hole 46, making the stripper unit 18 more stable and stronger than other stripper units.

The invention claimed is:

1. A self-contained stripper unit for attachment to a punch retainer having a punch retention hole with a punch received therein, the punch extending from the punch retainer and having a predetermined outside diameter where it extends from the punch retainer, the stripper unit having an installed position wherein it is received on the punch, the stripper unit comprising:

a hollow body having a threaded hole in a flat bottom thereof and an upper bore in the top of the hollow body;

a stripper disposed at least partially within the hollow body and movable in the upper bore;

a die spring engaging the stripper within the hollow body, the die spring located within the hollow body; and a precision threaded plug screwed into the threaded hole and leaving a flush surface across the bottom of the hollow body, the precision threaded plug engaging the die spring whereby the die spring and stripper are preloaded, the precision threaded plug having a multi-sided hole extending therethrough for receiving a multi-sided tool to tighten the plug, the multi-sided hole having a plurality of flats, each flat having a concave portion such that the concave portions cooperate to define an opening with a diameter matching the predetermined outside diameter of the punch, whereby when the stripper unit is received on the punch, the concave portions locate and align the stripper unit on the punch;

the precision threaded plug holding the stripper and the die spring at least partially within the hollow body and forming a self-contained unit that is attachable to the punch retainer as a single unit.

2. The stripper unit of claim 1, wherein the upper bore and the stripper have a D-shape to prevent rotation of the stripper relative to the hollow body.

3. The stripper unit of claim 1, wherein the threaded hole in the bottom of the hollow body has a counterbored ledge to seat the precision threaded plug on and thereby set the die spring preload.

4. The stripper unit of claim 1, wherein the stripper has a hole shaped to match a shape of the punch.

5. The stripper unit of claim 1, wherein the flush surface of the flat bottom of the self-contained stripper unit fits flush against the punch retainer when attached thereto.

6. The stripper unit of claim 1, wherein the multi-sided hole in the plug is a hexagonal hole.

* * * * *